US009254036B2

(12) United States Patent
Yang

(10) Patent No.: US 9,254,036 B2
(45) Date of Patent: Feb. 9, 2016

(54) EXPANDABLE FRAME STRUCTURE

(71) Applicant: HER SHENG CHANG INTERNATIONAL CO., LTD., Tainan (TW)

(72) Inventor: Chin-Te Yang, Tainan (TW)

(73) Assignee: HER SHENG CHANG INTERNATIONAL CO., LTD., Tainan (TW)

( * ) Notice: Subject to any disclaimer, the term of this patent is extended or adjusted under 35 U.S.C. 154(b) by 0 days.

(21) Appl. No.: 14/257,954

(22) Filed: Apr. 21, 2014

(65) Prior Publication Data

US 2014/0319090 A1 Oct. 30, 2014

(30) Foreign Application Priority Data

Apr. 25, 2013 (TW) ..... 102207576 U

(51) Int. Cl.
*A47B 47/00* (2006.01)
*A47B 87/00* (2006.01)
*A47B 57/16* (2006.01)

(52) U.S. Cl.
CPC ..... *A47B 47/00* (2013.01); *A47B 87/005* (2013.01); *A47B 57/16* (2013.01)

(58) Field of Classification Search
CPC .... A47B 47/00; A47B 47/0008; A47B 57/00; A47B 57/06; A47B 57/08; A47B 57/10; A47B 57/12; A47B 57/14; A47B 57/16; A47B 96/022
USPC ..... 211/133.2, 181.1, 186
See application file for complete search history.

(56) References Cited

U.S. PATENT DOCUMENTS

| | | | | | |
|---|---|---|---|---|---|
| 2,850,172 | A * | 9/1958 | Beckner | 108/107 |
| 2,919,817 | A * | 1/1960 | Maslow | 108/181 |
| 3,225,720 | A * | 12/1965 | Maslow | 108/64 |
| 3,680,712 | A * | 8/1972 | Jurasek | 211/59.2 |
| 4,226,190 | A * | 10/1980 | Ashton | 108/11 |
| 4,231,298 | A * | 11/1980 | Pollack | 108/64 |
| 4,391,378 | A * | 7/1983 | Secon | 211/187 |
| 5,027,959 | A * | 7/1991 | Luukkonen | 211/186 |
| 5,160,052 | A * | 11/1992 | Wudka | 211/90.02 |
| 5,167,331 | A * | 12/1992 | Luukkonen | 211/186 |
| 5,845,793 | A * | 12/1998 | Pan | 211/181.1 |
| 6,173,847 | B1 * | 1/2001 | Zellner et al. | 211/186 |
| 6,241,107 | B1 * | 6/2001 | Boyer | 211/181.1 |
| 2002/0130098 | A1 * | 9/2002 | Simard | 211/181.1 |
| 2006/0157435 | A1 * | 7/2006 | Oberhaus et al. | 211/187 |
| 2011/0220602 | A1 * | 9/2011 | Chen | 211/153 |

FOREIGN PATENT DOCUMENTS

| | | | | |
|---|---|---|---|---|
| DE | 3802625 | A1 * | 8/1988 | A47B 47/00 |
| DE | 10146734 | A1 * | 4/2003 | A47B 45/00 |
| FR | 2178315 | A5 * | 3/1972 | A47B 57/08 |
| FR | 2548529 | A1 * | 1/1985 | A47B 57/14 |

* cited by examiner

*Primary Examiner* — Joshua Rodden
(74) *Attorney, Agent, or Firm* — Cheng-Ju Chiang

(57) ABSTRACT

An expandable frame structure includes at least one set of a transverse plate assembly and at least two vertical frames. Each set of the transverse plate assembly includes at least two transverse plate parts. Each transverse plate part includes a quarter circular arc edge and two side edges spaced and spreading out from each other with 90 degrees in angles. Two lower hook fixing parts extend downward from two side edges, respectively. Each of the vertical frames includes a pair of vertical frame parts and at least two horizontal frame parts. So, each of the transverse plate parts is placed and installed onto the horizontal frame parts of the two vertical frames. The lower hook fixing part is inserted into and engages with the horizontal frame part to form the expandable frame structure. The advantages and effects are easy to assemble and flexible for structural assembling styles, and so on.

10 Claims, 12 Drawing Sheets

EXPANDABLE FRAME STRUCTURE

BACKGROUND OF THE INVENTION

1. Field of the Invention

The present invention relates to an expandable frame structure, particularly with regard to an expandable frame structure with a lower hook fixing part. The present invention has advantages and effects of being easy to assemble and flexible for structural assembling styles, and so on.

2. The Related Arts

As shown in FIG. 15, a conventional ordinary article-placed shelf 90 commonly available in the market has a plurality of transverse plates 91 and a plurality of fixing racks 92. The transverse plate 91 is fixed onto the fixing rack 92 by general commonly-seen assembling ways such as screwing, sheathing engagement, and so on.

However, there is no further interconnection design for more than one of such shelf 90 to interconnect with each other based on the above mentioned fixing way of the shelf 90. Besides, its size and range designs are mostly suitable for placing bathroom appliances. Therefore, such shelf 90 can not be handy when users require a larger size/area to place more articles or require different shelf-arranging styles. The only convenient way for users is to purchase another shelf with larger sizes/areas or of different styles.

Therefore, it is necessary to develop new products to solve these shortcomings and problems as stated above.

SUMMARY OF THE INVENTION

The main objective of the present invention is to provide an extendable frame structure which has advantages and effects of being easy to assemble and flexible for structural assembling styles, and so on, in order to improve the above mentioned problem of prior techniques, i.e., unable to further assemble more than one shelf together.

The technical means adopted and used in the present invention for solving the problems depicted above is to provide an expandable frame structure. The expandable frame structure comprises at least one set of a transverse plate assembly. Each set of the transverse plate assembly comprises at least two transverse plate parts. Each transverse plate part is a plate-like structure of a quarter circle shape, and comprises a quarter circular arc edge and two side edges spaced and spreading out from each other with 90 degrees in angels. Two lower hook fixing parts extend downward from the two side edges, respectively.

The expandable frame structure further comprises at least two vertical frames. Each of the vertical frames comprises a pair of vertical frame parts and at least two horizontal frame parts. The pair of vertical frame parts are adjacent and parallel to each other, and spaced from each other by a first distance. Each vertical frame part has a cross-section which is substantially square. Each of the horizontal frame parts comprises an inner fringe and an outer fringe. A plurality of connecting parts are disposed on the inner fringe and used to be integrally fixed with the vertical frame parts.

By this way, each of the transverse plate parts is placed and installed onto the horizontal frame parts of the at least two vertical frames. The lower hook fixing part is inserted into and engages with the inner fringe of the horizontal frame part in order to form the expandable frame structure.

DETAILED DESCRIPTION OF PREFERRED EMBODIMENT

Figure 1:
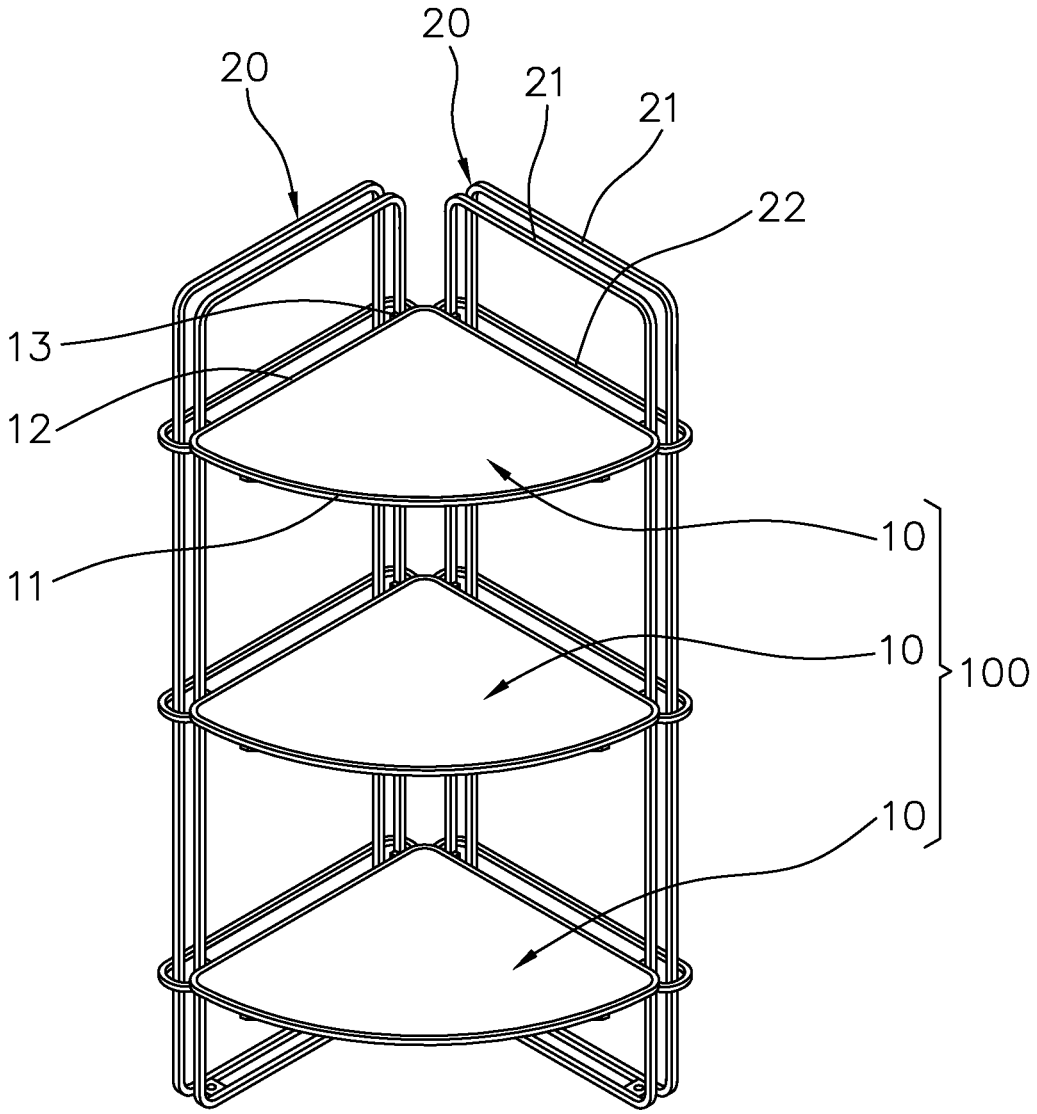
FIG. 1 shows a schematic perspective view of an expandable frame structure in accordance with the present invention.
Figure 2:
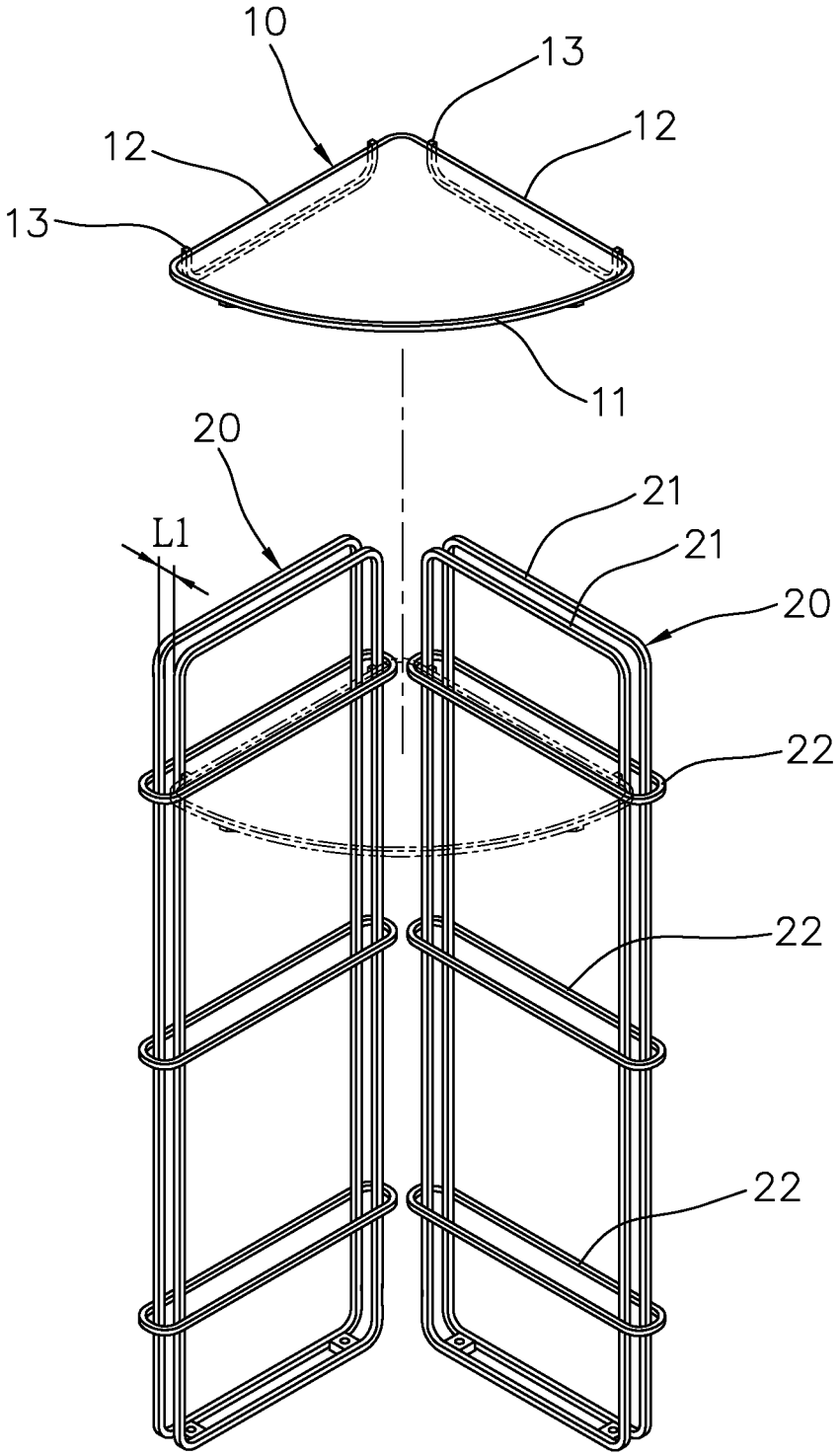
FIG. 2 shows a schematic exploded perspective view of the expandable frame structure in accordance with the present invention.
Figure 3A:
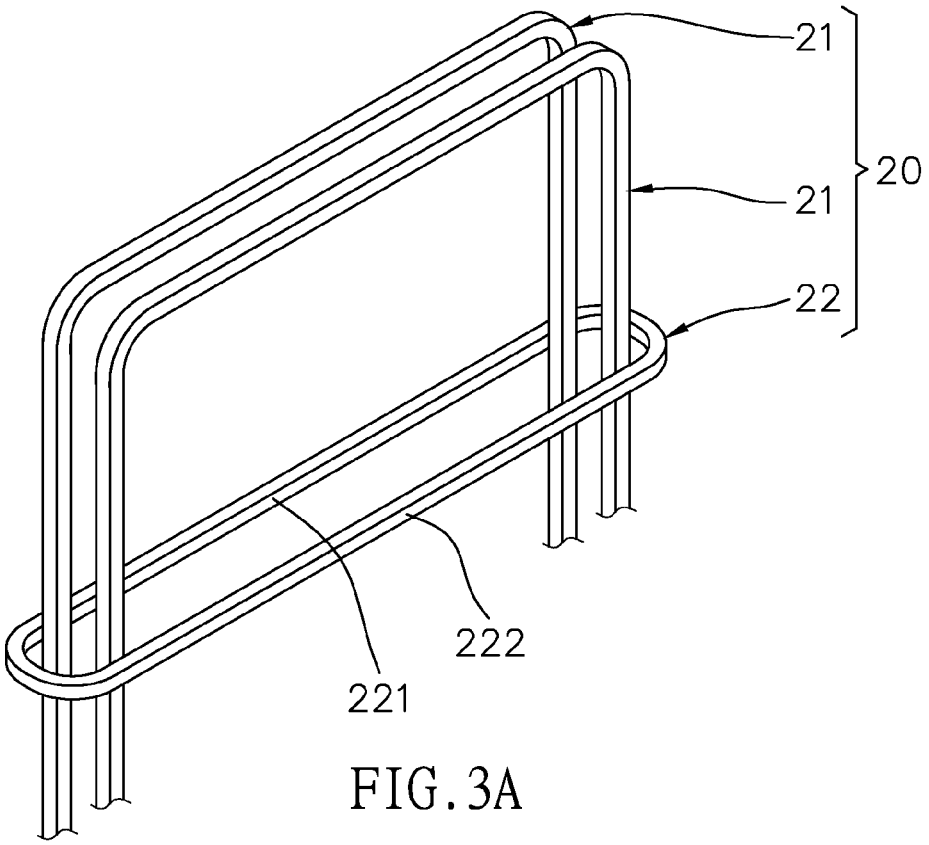
FIG. 3A shows a partial enlarged schematic perspective view of a vertical frame in accordance with the present invention.
Figure 3B:
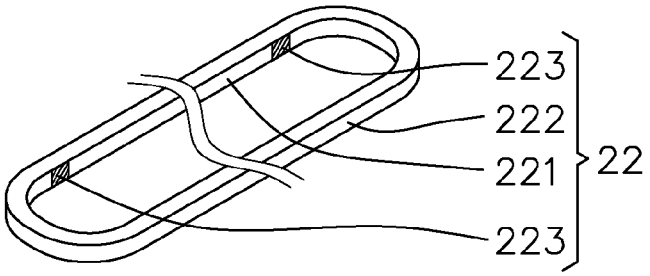
FIG. 3B shows a partial enlarged schematic perspective view of a connecting part in accordance with the present invention.
Figure 3C:
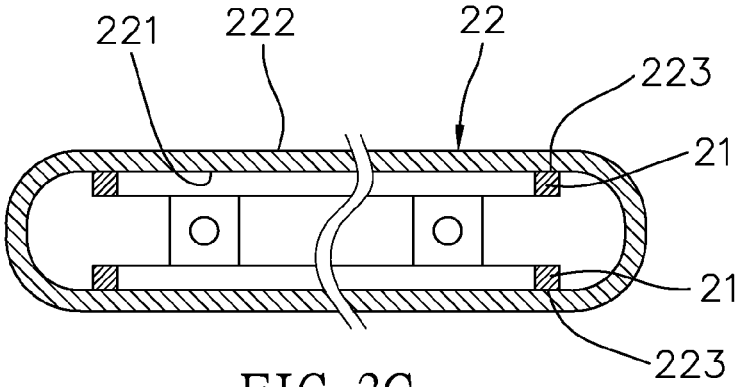
FIG. 3C shows a schematic cross-sectional view of the connecting part and a vertical frame part of the vertical frame in accordance with the present invention.
Figure 4:
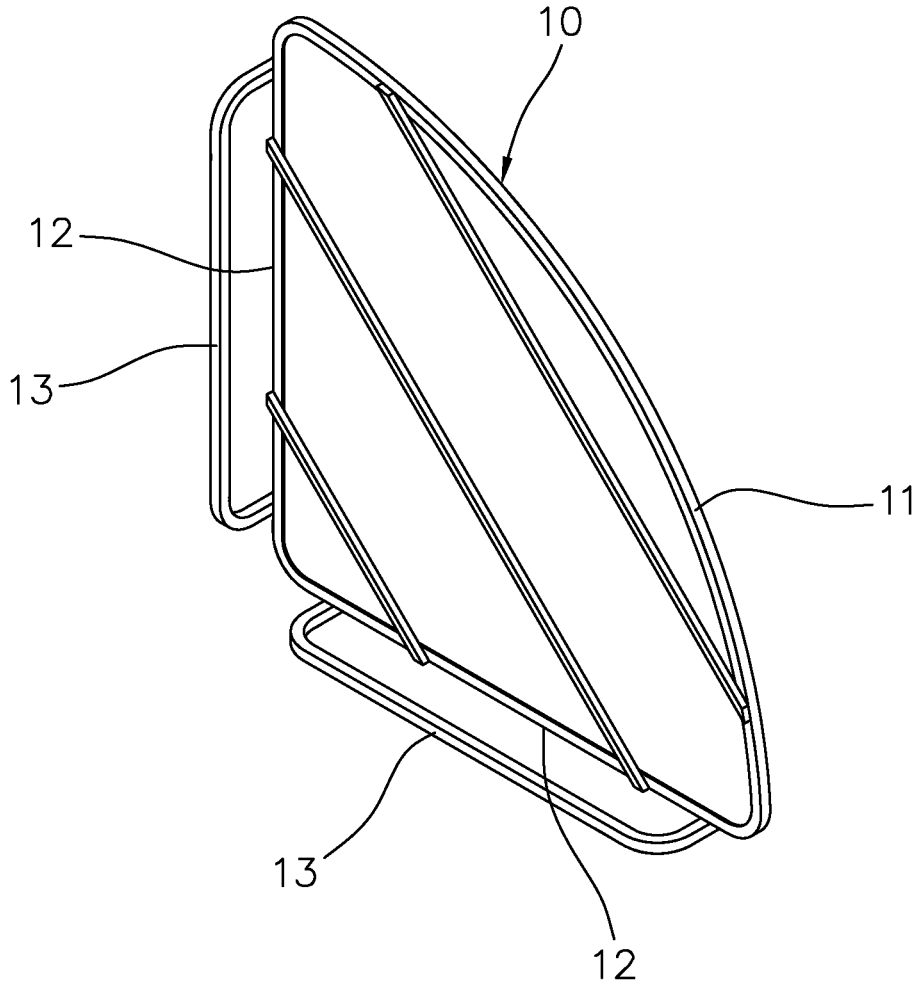
FIG. 4 shows a schematic perspective view of a transverse plate part in accordance with the present invention.
Figure 5:
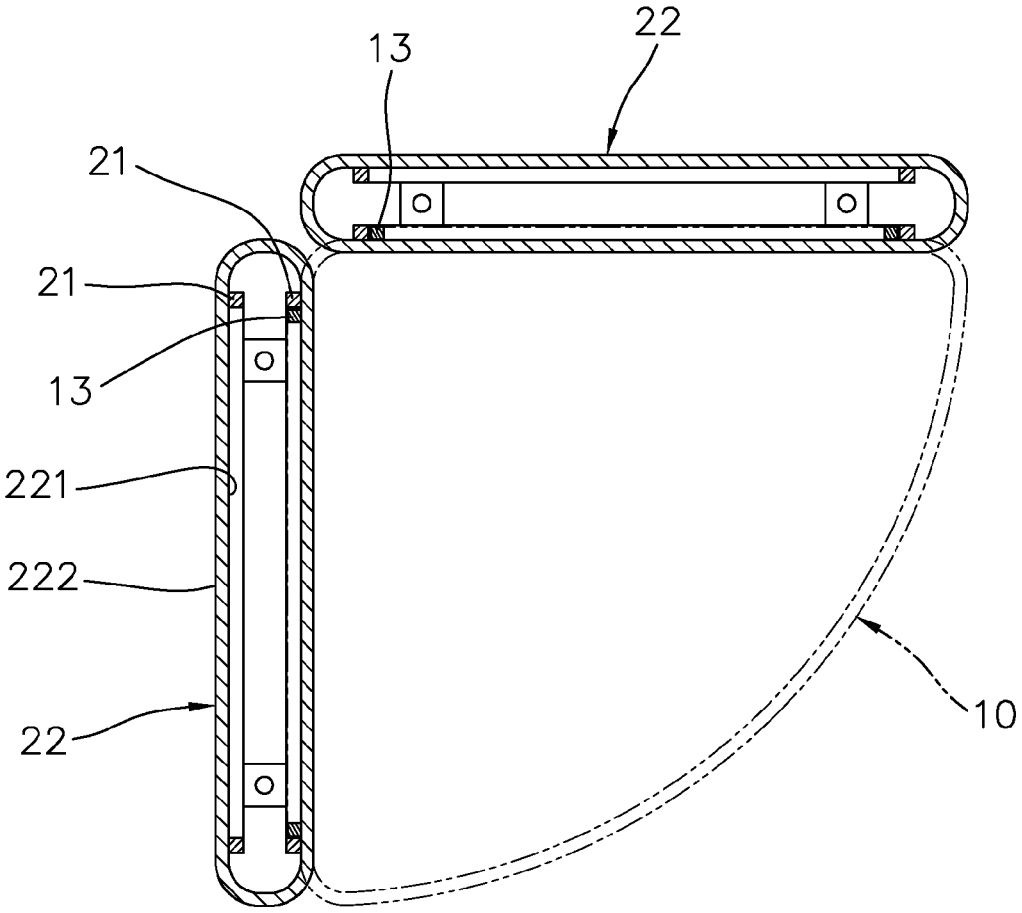
FIG. 5 shows a schematic cross-sectional view from a first perspective viewing angle showing a lower hook fixing part placed and installed onto an horizontal frame part in accordance with the present invention.
Figure 6:
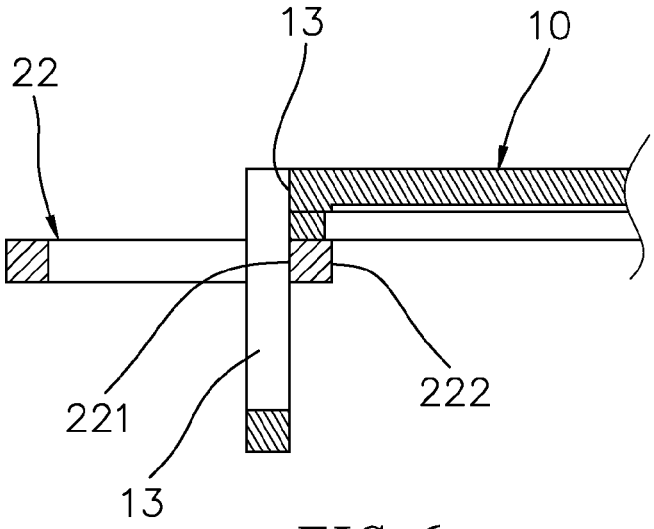
FIG. 6 shows a schematic cross-sectional view from a second perspective viewing angle showing the lower hook fixing part placed and installed onto the horizontal frame part in accordance with the present invention.

With reference to FIGS. 1 to 6, a first embodiment of an expandable frame structure in accordance with the present invention comprises at least one set of a transverse plate assembly 100 comprising three transverse plate parts 10. Each transverse plate part 10 is a plate-like structure of a quarter circle shape, and comprises a quarter circular arc edge 11 and two side edges 12 spaced and spreading out from each other with 90 degrees in angles. Two lower hook fixing parts 13 extend downward from the two side edges 12, respectively.

The expandable frame structure further comprises two vertical frames 20. Each of the vertical frames 20 comprises a pair of vertical frame parts 21 and three horizontal frame parts 22. The pair of vertical frame parts 21 are adjacent and parallel to each other, and spaced from each other by a first distance L1. Each vertical frame part 21 has a cross-section which is substantially square. Each of the horizontal frame parts 22 comprises an inner fringe 221 and an outer fringe 222. A plurality of connecting parts 223 are disposed on the inner fringe 221 and used to be integrally fixed with the vertical frame parts 21.

By this way, each of the transverse plate parts 10 is placed and installed onto the horizontal frame parts 22 of the two vertical frames 20. The lower hook fixing part 13 is inserted into and engages with the inner fringe 221 of the horizontal frame part 22 in order to form the expandable frame structure of the present invention.

Of course, the horizontal frame part 22 of the vertical frame 20 can be of a different quantity according to different needs for use and installation of a different quantity of the transverse plate parts 10. According to a preferred embodiment of the present invention, at least two horizontal frame parts 22 are disposed to make the vertical frame 20 becoming steady and balanced.

As to the connecting part 223 aspect, the connecting part 223 is fixed to the vertical frame part 21 by generally existing connection technologies (for example, welding). No further details regarding the adopted connection technology is provided herewith.

Figure 7:
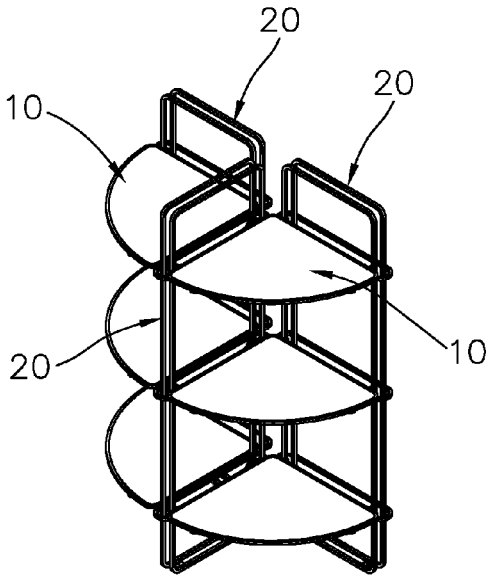
FIG. 7 shows a schematic perspective view of a second embodiment in accordance with the present invention.

In more detail, of course, in addition to the above mentioned first embodiment, the present invention also has the following four embodiment variations. As shown in FIG. 7, the second embodiment of the present invention is shown. Two sets of the transverse plate assembly 100 and three vertical frames 20 are presented. The transverse plate parts 10 of the two sets of the transverse plate assembly 100 are placed and installed onto the horizontal frame parts 22 of each of the vertical frames 20. After installation, adjacent ones of the transverse plate parts 10 at a same level form a half circle structure together.

Figure 8:
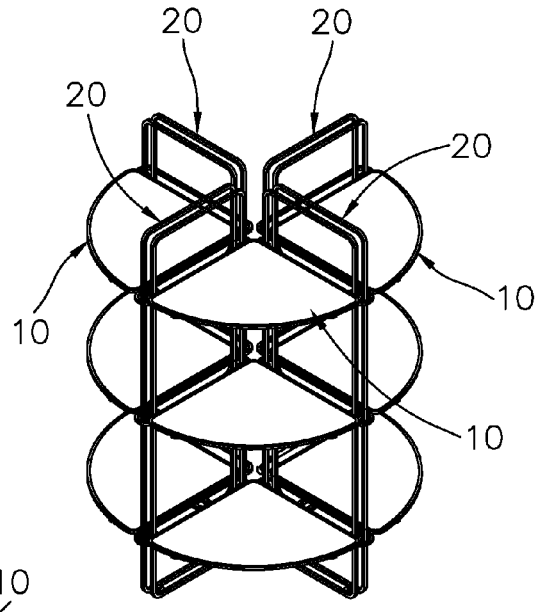
FIG. 8 shows a schematic perspective view of a third embodiment in accordance with the present invention.

As shown in FIG. 8, the third embodiment of the present invention is shown. Three sets of the transverse plate assembly 100 and four vertical frames 20 are presented. The transverse plate parts 10 of the three sets of the transverse plate assembly 100 are placed and installed onto the horizontal frame parts 22 of each of the vertical frames 20. After installation, adjacent ones of the transverse plate parts 10 at a same level form a three-quarter circle structure together.

Figure 9:
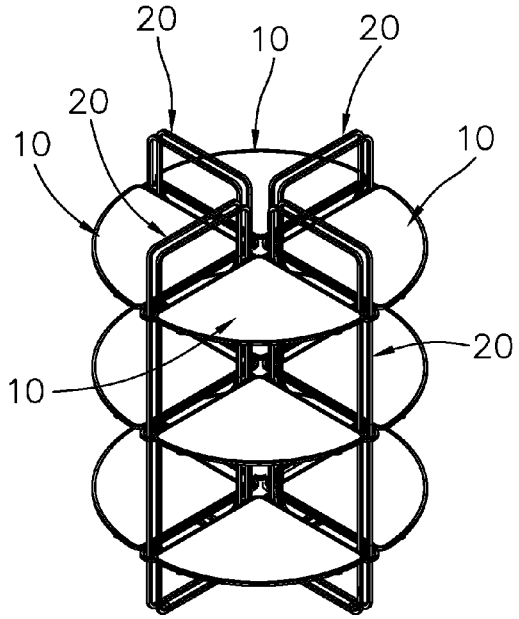
FIG. 9 shows a schematic perspective view of a fourth embodiment in accordance with the present invention.

As shown in FIG. 9, the fourth embodiment of the present invention is shown. Four sets of the transverse plate assembly 100 and four vertical frames 20 are presented. The transverse plate parts 10 of the four sets of the transverse plate assembly 100 are placed and installed onto the horizontal frame parts 22 of each of the vertical frames 20. After installation, adjacent ones of the transverse plate parts 10 at a same level form a circle structure together.

Figure 10:
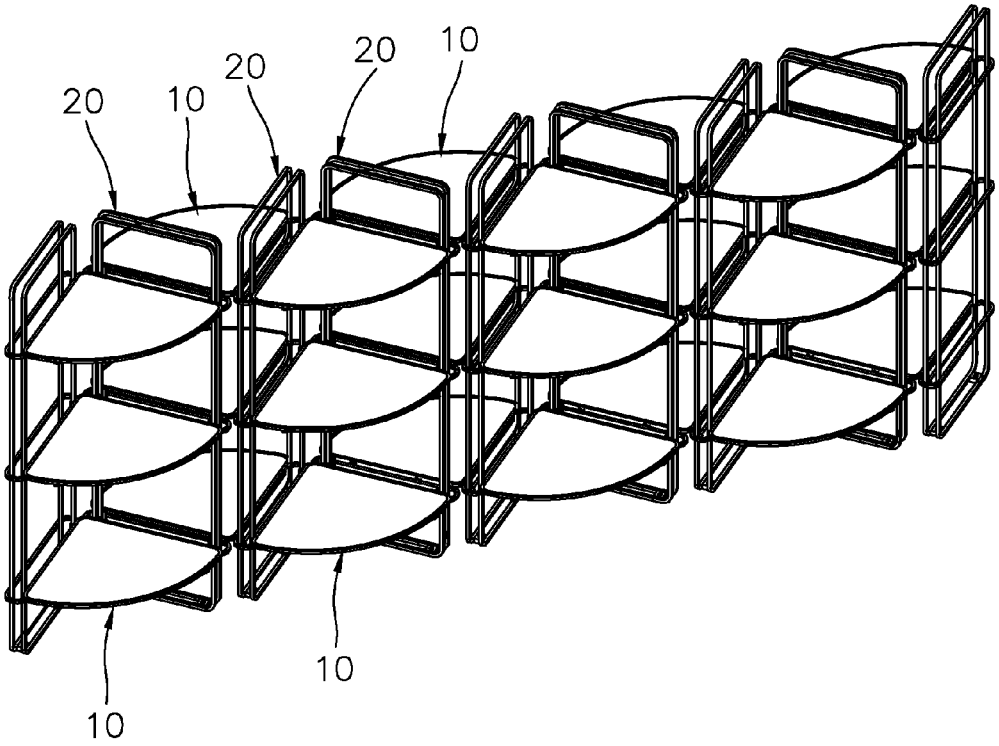
FIG. 10 shows a schematic perspective view of a fifth embodiment in accordance with the present invention.

As shown in FIG. 10, the fifth embodiment of the present invention is shown. Eight sets of the transverse plate assembly 100 and nine vertical frames 20 are presented. Adjacent ones of the transverse plate parts 10 roughly form a continuously curved structure together (for use of a screen or a bar). In this embodiment, the transverse plate assembly 100 comprises N sets thereof, and a number of the vertical frames 20 is N+1, wherein N is a positive integer complying with the following equation: $N \geq 4$.

Figure 11:
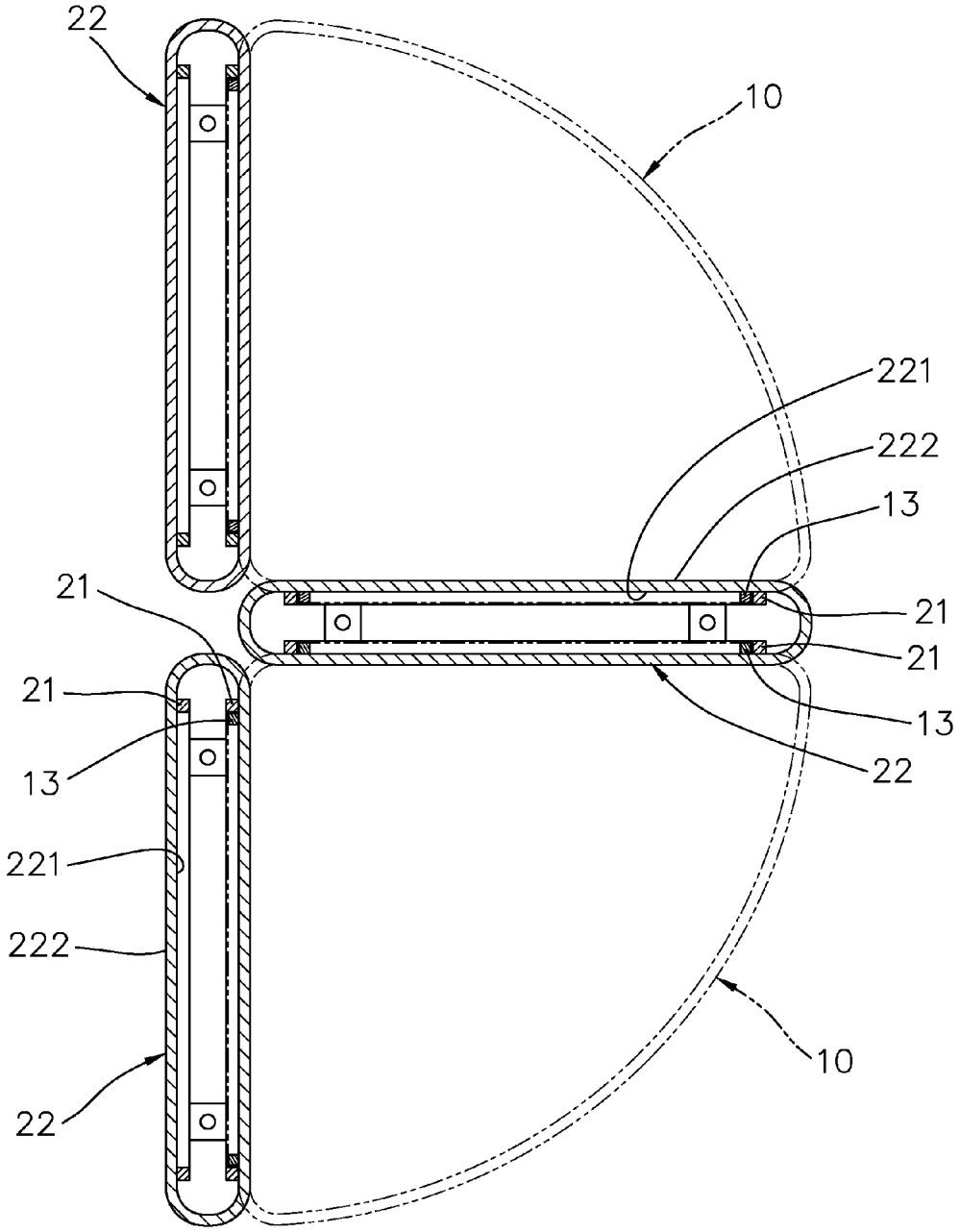
FIG. 11 shows a schematic cross-sectional view of two of the lower hook fixing parts placed and installed at a same horizontal frame part in accordance with the present invention.

As shown in FIG. 11, a space enclosed by the inner fringe 221 of the horizontal frame part 22 of the present invention can allow two of the lower hook fixing parts 13 to be simultaneously inserted into the space and to engage with the inner fringe 221. In other words, the lower hook fixing parts 13 of two adjacent ones of the transverse plate parts 10 at a same level can be inserted into the space and engage with the inner fringe 221 of a same horizontal frame part 22. By this way, assembling variations as shown in FIGS. 7 to 10 can be formed and achieved.

Figure 12A:
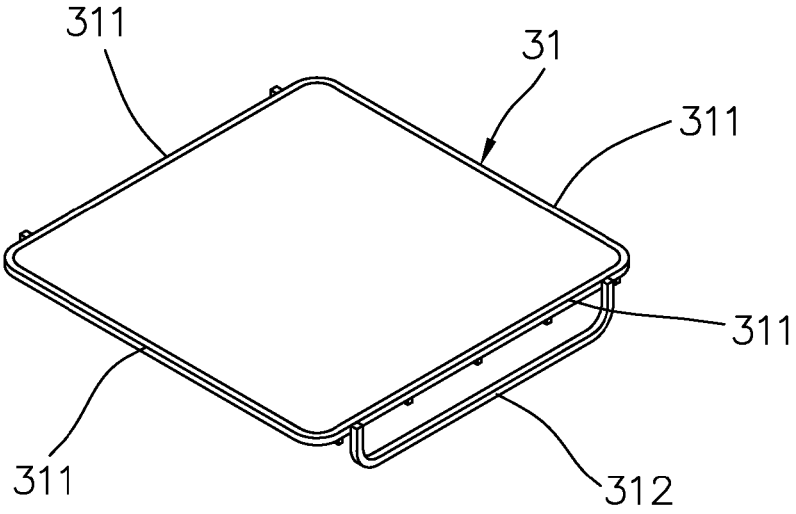
FIG. 12A shows a schematic perspective view from a first perspective viewing angle of a rectangular transverse plate part of another embodiment in accordance with the present invention.
Figure 12B:
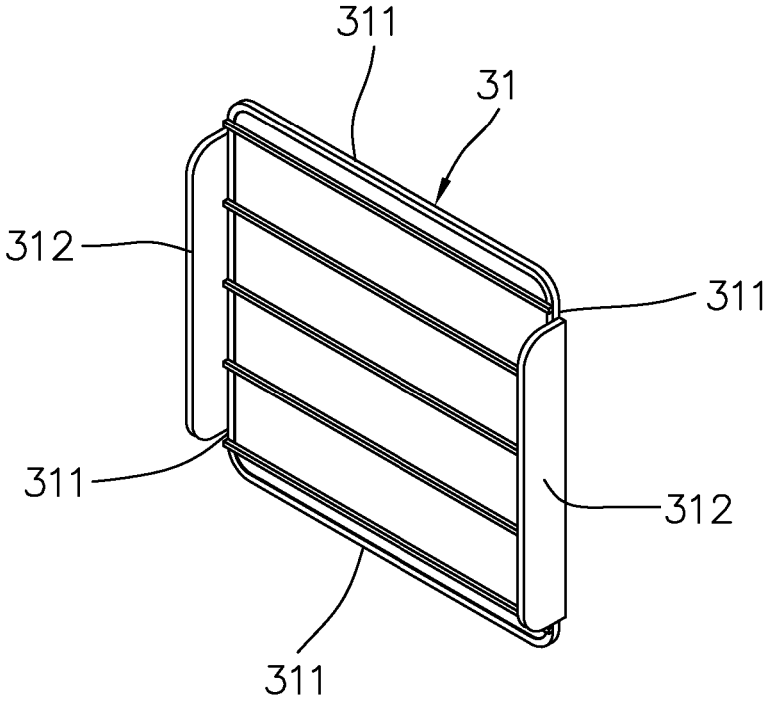
FIG. 12B shows a schematic perspective view from a second perspective viewing angle of the rectangular transverse plate part of another embodiment in accordance with the present invention.

As shown in FIG. 12A, the extendable frame structure of the present invention can also comprise at least one rectangular transverse plate part 31. Each rectangular transverse plate part 31 comprises four sides 311, and wherein two lower hook fixing parts 312 respectively extend downward from two opposites ones of the sides 311 of the rectangular transverse plate part 31. Furthermore, the lower hook fixing part 312 of the rectangular transverse plate part 31 can be hollow as shown in FIG. 12A by being formed from a bent strip. As further shown in FIG. 12B, it can be formed of a solid plate shape (Of course, the lower hook fixing part 13 of the transverse plate part 10 of the first embodiment can be formed from the bent strip or be of the solid plate shape).

By this way, the rectangular transverse plate part 31 is placed and installed onto the horizontal frame parts 22 of two of the vertical frame parts 20 which are parallel positioned to each other. The lower hook fixing part 312 of the rectangular transverse plate part 31 is inserted into and engages with the inner fringe 221 of the horizontal frame part 22.

Figure 13:
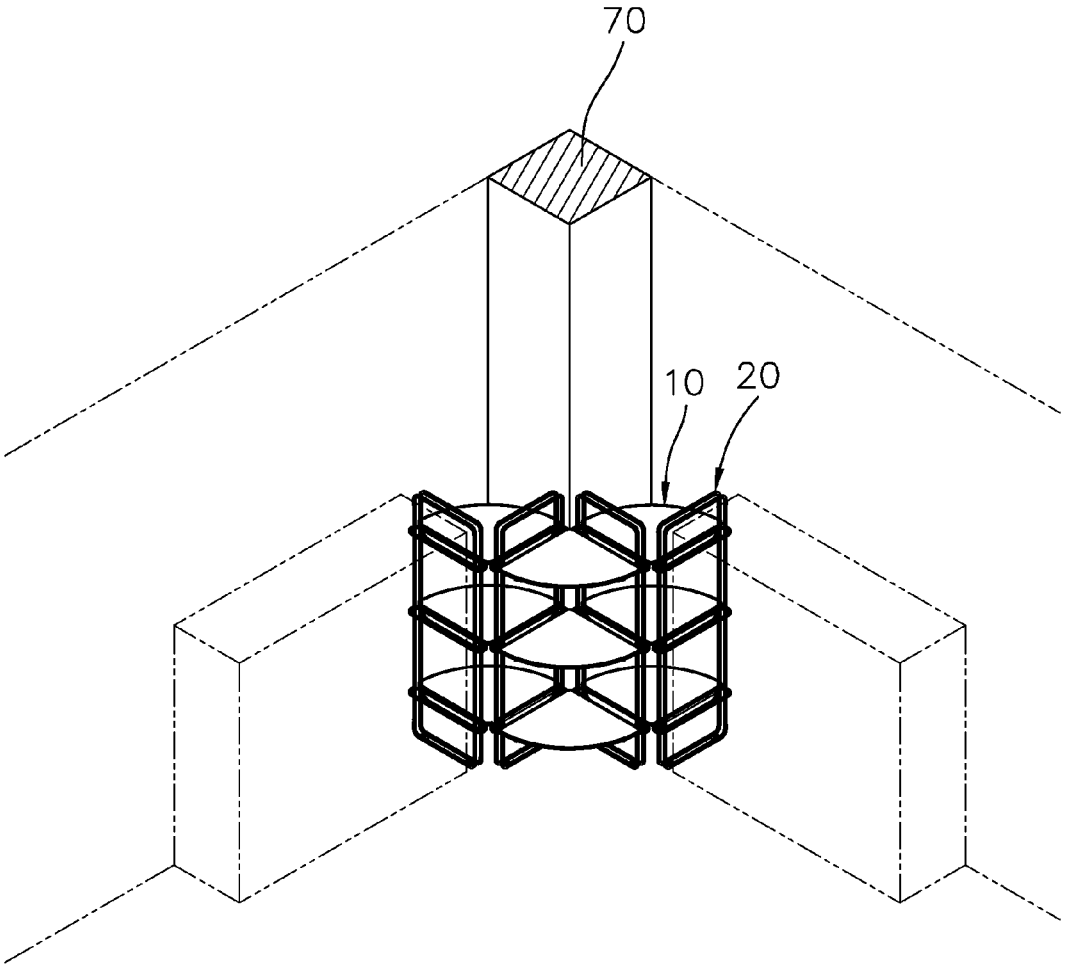
FIG. 13 shows a schematic perspective view of a sixth embodiment in accordance with the present invention.

As shown in FIG. 13, the sixth embodiment of the present invention is shown. When there is a column 70 disposed at a certain corner of a room, such column often causes difficulty and confusion of display placement. However, taking advantage of flexible assembling variations of the present invention, adjacent transverse plate parts 10 installed at a same level can be arranged and bent around the column 70 of the corner, and two distal ends of the adjacent transverse plate parts 10 can be further expanded depending on different demands or be used to place other objects (such as expansion with extra ones of the rectangular transverse plate parts 31).

Figure 14A:
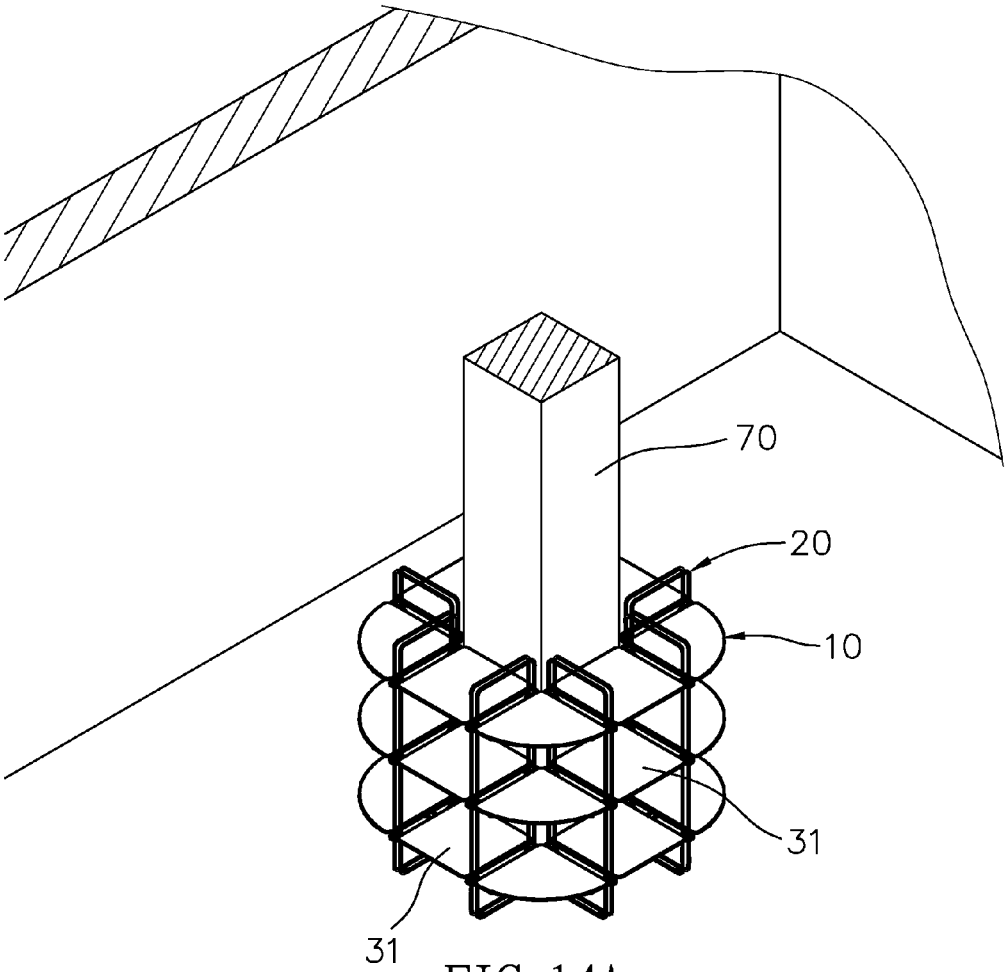
FIG. 14A shows a schematic perspective view of a seventh embodiment in accordance with the present invention.
Figure 14B:
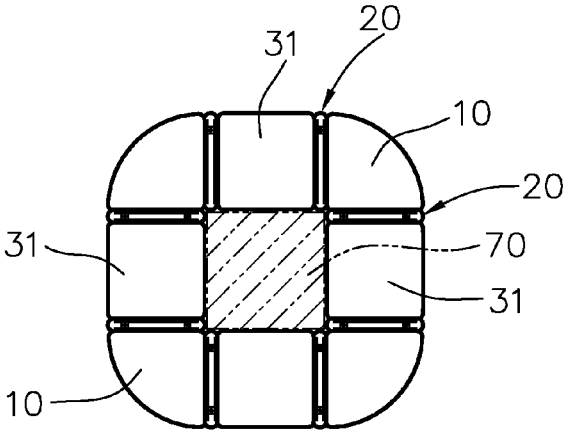
FIG. 14B shows a schematic cross-sectional plan view from a downward viewing angle of the seventh embodiment in accordance with the present invention.
Figure 15:
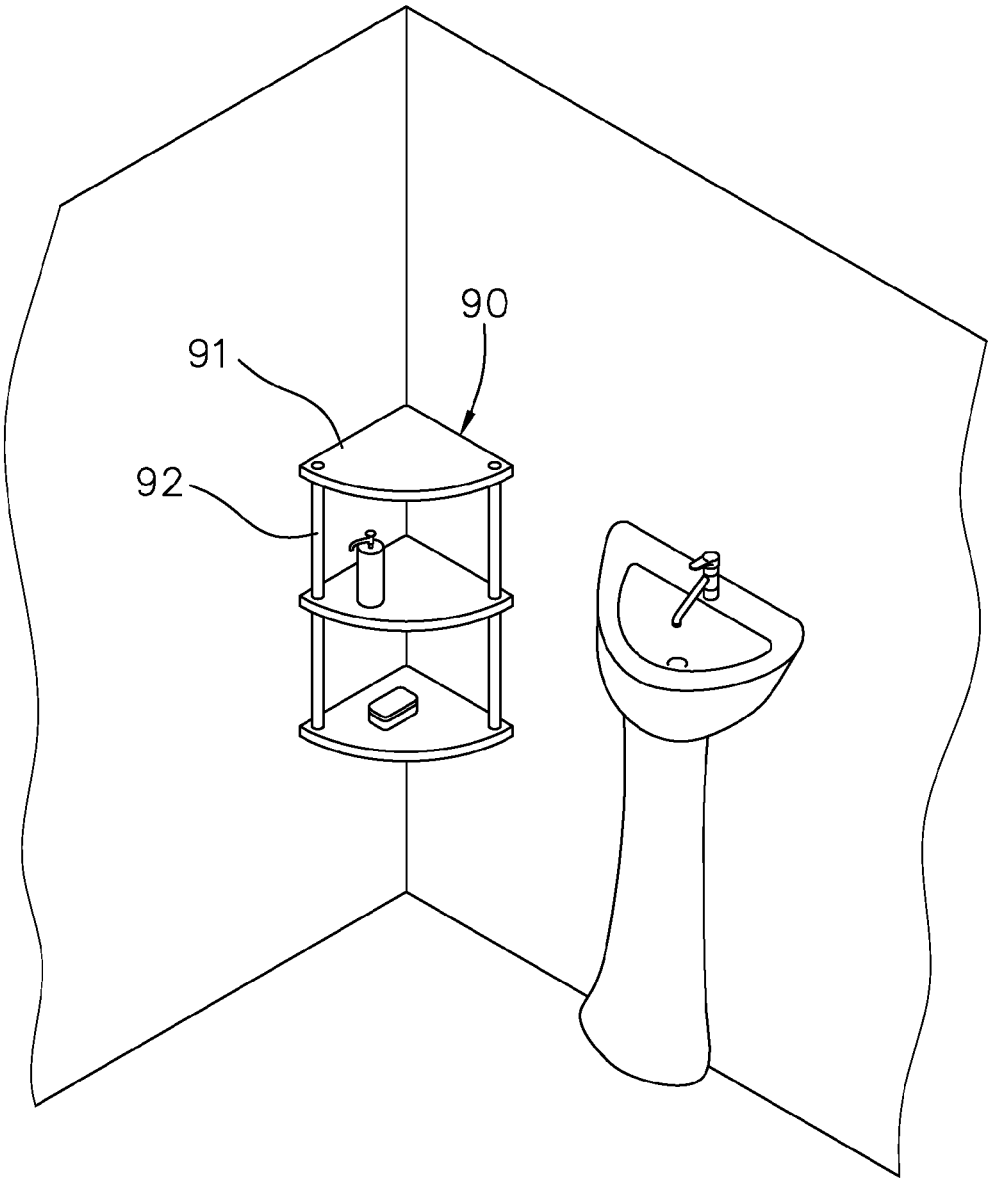
FIG. 15 (Prior Art)
FIG. 15 shows a schematic perspective view of a conventional ordinary article-placed shelf.

As shown in FIG. 14A and FIG. 14B, the seventh embodiment of the present invention is shown. When there is an independent column 70 at a central of a room, staggered arrangement of the transverse plate parts 10 of a quarter circle shape and the rectangular transverse plate part 31 can be used for assembly of the extendable frame structure of the present invention. Hence, the adjacent transverse plate parts 10 and the rectangular transverse plate parts 31 installed at a same level can be arranged and bent around the column 70 of a rectangular cross-section so as to be placed and installed closely at four corners and four side faces of the column 70 (i.e., each of the transverse plate part 10 corresponding to the four corners, and each rectangular transverse plate part 31 corresponding to the four side faces).

In addition, shapes and sizes of the lower hook fixing parts 13 of the transverse plate part 10 and the lower hook fixing parts 312 of the rectangular transverse plate part 31 are substantially the same. Thus, the space enclosed by the inner fringe 221 of the horizontal frame part 22 of the present invention can not only allow two of the lower hook fixing parts 13 to be simultaneously inserted into the space, but also allow one of the lower hook fixing parts 312 of the rectangular transverse plate part 31 and one of the lower hook fixing parts 13 to be simultaneously inserted into the space, or allow two of the lower hook fixing parts 312 of the rectangular transverse plate parts 31 to be simultaneously inserted into the space. In other words, no matter there are two adjacent ones of the transverse plate parts 10, one of the transverse plate parts 10 and one of the rectangular transverse plate parts 31 adjacent to each other, or two adjacent ones of the rectangular transverse plate parts 31, every two of the lower hook fixing parts 13 and/or the lower hook fixing parts 312 can be inserted into the space and engage with the inner fringe 221 of a same horizontal frame part 22.

Based on the above descriptions, the present invention uses designs of the transverse plate assembly 100 and the vertical frame 20 to form the expandable frame structure of the present invention by placing and installing the transverse plate part 10 onto the horizontal frame parts 22 of each of the vertical frames 20. The expandable frame structure can be arranged according to different needs to become a quarter circle assembling style, a half circle assembling style, a three-quarter circle assembling style, a circle assembling style or a continuously curved assembling style. Such design is not only able to assemble and/or disassemble quickly, but also able to be changeably assembled into a variety of different styles for further adjusting flexibly depending on user's needs.

In summary, advantages and effects of the present invention can be summarized as follows:

(a) Easy to assemble. The present invention uses the lower hook fixing part 13 of the transverse plate part 10 to be placed and installed onto the horizontal frame part 22 of each vertical frame 20 for forming the expandable frame structure of the present invention. It is no need to have any complicated conventional fixing process such as screw locking or sheathing connection, and so on. Hence, the present invention has advantages of being easy to assemble.

(b) Flexible structural assembling styles. There is no interconnection design for the fixing way of the general conventional shelf 90, and its size and range designs are always limited to placement of bathroom appliances. Therefore, such shelf 90 cannot be handy when users require a larger size/area to place more articles or require different shelf-arranging styles. Users only can purchase other article-placing shelf of larger sizes/areas or of different styles. The present invention uses the transverse plate part 10 to be placed and installed onto the horizontal frame part 22 of each vertical frame 20 for forming the expandable frame structure of the present invention. The expandable frame structure can be arranged according to different needs to become a quarter circle assembling style, a half circle assembling style, a three-quarter circle assembling style, a circle assembling style or a continuously curved assembling style. Such design is not only able to assemble and/or disassemble quickly, but also able to be changeably assembled into a variety of different styles. Hence, the present invention has advantages of Flexible structural assembling styles.

Described above is only used for explanation and description of a preferred embodiment of the present invention. Where those skilled in this art can make all sorts of other changes or improvements based on the above description, the changes or improvements are still covered within the inventive spirit of the present invention and the scope as defined in the following claims.

What is claimed is:

1. An expandable frame structure, comprising:

at least one set of a transverse plate assembly comprising transverse plate parts respectively assigned to at least two different levels for installation, each transverse plate part being a plate-like structure of a quarter circle shape, and comprising a quarter circular arc edge and two side edges spaced and spreading out from each other with 90 degrees in angles, two lower hook fixing parts extending downward from the two side edges, respectively; and at least two vertical frames, each of the at least two vertical frames comprising a pair of vertical frame parts and at least two horizontal frame parts, the pair of vertical frame parts adjacent and parallel to each other, and spaced from each other by a first distance, each of the pair of vertical frame parts having a cross-section which is square, each of the at least two horizontal frame parts comprising an inner fringe and an outer fringe, a plurality of connecting parts disposed on the inner fringe and used to be integrally fixed with the pair of vertical frame parts;

wherein each of the transverse plate parts is placed and installed onto one of the at least two horizontal frame parts of the at least two vertical frames, and the lower hook fixing parts are inserted into and engage with the inner fringes of the at least two horizontal frame parts in order to form the expandable frame structure.

2. The expandable frame structure as claimed in claim 1, wherein the transverse plate assembly comprises one set of the transverse plate assembly, the at least two vertical frames have a number of two, and each of the transverse plate parts of the one set of the transverse plate assembly form a quarter circle shape structure.

3. The expandable frame structure as claimed in claim 1, wherein the transverse plate assembly comprises two sets of the transverse plate assembly, the at least two vertical frames have a number of three, and adjacent ones of the transverse plate parts of the two sets of the transverse plate assembly at a same assigned level form a half circle shape structure together.

4. The expandable frame structure as claimed in claim 1, wherein the transverse plate assembly comprises three sets of the transverse plate assembly, the at least two vertical frames have a number of four, and adjacent ones of the transverse plate parts of the three sets of the transverse plate assembly at a same assigned level form a three-quarter circle structure together.

5. The expandable frame structure as claimed in claim 1, wherein the transverse plate assembly comprises four sets of the transverse plate assembly, the at least two vertical frames have a number of four, and adjacent ones of the transverse plate parts of the four sets of the transverse plate assembly at a same assigned level form a circle structure together.

6. The expandable frame structure as claimed in claim 1, wherein the transverse plate assembly comprises N sets of the transverse plate assembly, and the at least two vertical frames have a number of N+1, and adjacent ones of the transverse plate parts of the N sets of the transverse plate assembly at a same assigned level form a continuously curved structure together, wherein N is a positive integer complying with the following equation: $N \geq 4$.

7. The expandable frame structure as claimed in claim 1, wherein a space enclosed by the inner fringe of the each horizontal frame part allows two of the lower hook fixing parts to be simultaneously inserted into the space and to engage with the inner fringe.

8. The expandable frame structure as claimed in claim 1, further comprising at least one rectangular transverse plate part, each of the at least one rectangular transverse plate part comprising four sides, wherein two lower hook fixing parts respectively extend downward from two opposite ones of the four sides of the at least one rectangular transverse plate part, the at least one rectangular transverse plate part is placed and installed onto the horizontal frame parts of two of the vertical frames, and the lower hook fixing parts of the at least one rectangular transverse plate part are inserted into and engage with the inner fringes of the horizontal frame parts, respectively.

9. The expandable frame structure as claimed in claim 8, wherein a space enclosed by the inner fringe of the each horizontal frame part allows one of the lower hook fixing parts of the transverse plate parts and one of the lower hook fixing parts of the rectangular transverse plate parts to be simultaneously inserted into the space and to engage with the inner fringe.

10. The expandable frame structure as claimed in claim 8, wherein a space enclosed by the inner fringe of the each horizontal frame part allows two of the lower hook fixing parts of the rectangular transverse plate parts to be simultaneously inserted into the space and to engage with the inner fringe.

* * * * *